US006254744B1

(12) United States Patent
Larsson

(10) Patent No.: US 6,254,744 B1
(45) Date of Patent: Jul. 3, 2001

(54) HOLDER FOR A MOTHER PLATE

(75) Inventor: Hans-O Larsson, Kil (SE)

(73) Assignee: Outokumpu OYJ, Espoo (FI)

( * ) Notice: Subject to any disclaimer, the term of this patent is extended or adjusted under 35 U.S.C. 154(b) by 0 days.

(21) Appl. No.: 09/485,072

(22) PCT Filed: Aug. 7, 1998

(86) PCT No.: PCT/FI98/00621

§ 371 Date: Apr. 3, 2000

§ 102(e) Date: Apr. 3, 2000

(87) PCT Pub. No.: WO99/07920

PCT Pub. Date: Feb. 18, 1999

(30) Foreign Application Priority Data

Aug. 11, 1997 (FI) ..... 973288

(51) Int. Cl.[7] ..... B23H 3/04

(52) U.S. Cl. ..... 204/286.1; 204/288.3; 204/297.01; 204/297.07; 204/297.09; 204/297.1; 204/297.14

(58) Field of Search ..... 204/281, 286.1, 204/288.3, 297.01, 297.07, 297.09, 297.1, 297.14

(56) References Cited

U.S. PATENT DOCUMENTS

| | | | | |
|---|---|---|---|---|
| 3,953,312 | * | 4/1976 | Kikkawa et al. | 204/281 |
| 4,049,527 | * | 9/1977 | Harimoto et al. | 204/281 |
| 4,806,213 | * | 2/1989 | Leiponen et al. | 204/297.01 |
| 5,567,285 | * | 10/1996 | Sitges Menendez et al. | 204/281 |
| 6,079,093 | * | 6/2000 | Segerström | 204/281 |

* cited by examiner

*Primary Examiner*—Bruce F. Bell
(74) *Attorney, Agent, or Firm*—Smith-Hill and Bedell

(57) ABSTRACT

The invention relates to a holder to be used during the stripping of a metal deposit produced on the surface of a mother plate in electrolytic refining, which mother plate has a supporting bar (12) fixed at one edge of the plate for supporting the mother plate during the stripping (16), and an edge strip (10) at least on the edge opposite to where the supporting bar (12) is fixed. According to the invention the holder (1) has at least one pressing member (4), so that during the stripping (16) the metal deposit (15) is pressed by the pressing member (4) in order to make a contact between the deposit (15) and the pressing member (4) close to the edge strip (10) installed on the edge opposite to where the supporting bar (12) is fixed.

8 Claims, 1 Drawing Sheet

HOLDER FOR A MOTHER PLATE

The invention relates to a holder for a mother plate used in the electrolytic refining of metals, such as copper, zinc and nickel, in order to prevent damages in the bottom edge strip of the mother plate during the stripping process stage of the mother plate.

The refining of many metals, such as copper, zinc and nickel, includes an electrolytic stage where harmful impurities are separated from the metal to be produced. The metal produced in electrolytic refining is gathered on the cathode by means of electric current. Usually electrolytic refining is carried out in tanks filled with an electrolyte containing sulphuric acid and, immersed therein, a number of plate-like anodes and cathodes made of some electroconductive material and placed in an alternating fashion. At the top edges, the anodes and cathodes are provided with lugs or bars for suspending them at the tank edges and for connecting them to the power circuit. The metal to be produced is brought into the electrolytic process either as soluble anodes, so-called active anodes, or as dissolved in the electrolyte at some preceding process stage, in which case the employed anodes are insoluble, so-called passive anodes.

The cathode used in electrolytic refining can be produced of the desired metal to be produced, in which case the deposit need not be stripped from the original cathode plate. Usually, however, the cathode, i.e. the mother plate, to be immersed in the electrolytic tank is made of some other metal than the one to be produced. Such materials of the mother plate can be for instance stainless steel, aluminum or titanium. In that case the metal to be produced is gathered on the surface of the mother plate in deposits, which are stripped from the mother plate at defined intervals.

Owing to electric current, the metal produced in electrolytic refining is accumulated in deposits on all electroconductive surfaces of the mother plate, i.e. if the mother plate is completely electroconductive, the metal to be produced covers in a uniform deposit the mother plate in all parts immersed in the electrolyte. Now the deposits of the metal to be produced, accumulated on two sides of the mother plate, are on three sides attached to each other over the narrow edges of the mother plate, and thus the deposits of the metal to be produced are extremely difficult to remove from the mother plate. In order to facilitate the removal of the deposits of the metal to be produced from the surfaces of the mother plate, it is necessary to prevent the metal to be produced from accumulating deposits over the narrow edges of the mother plate, i.e. the edges of the mother plate must be made non-conductive. The best-known way to make the edges of the mother plate non-conductive is to cover the edges with edge strips made of some insulating material. such as plastic. Generally the insulating strips are plastic profiles with a groove-shaped cross-section, and they are pressed onto the edges of the mother plate and remain in place either owing to the pressure created by the transformation, by rivets inserted through the mother plate or due to a combination of these.

The deposit accumulated on two sides of the mother plate is stripped off for instance by using a stripping device described in the U.S. Pat. 4,806,213. In this patent the peeling blades are knifelike blades which are stuck in between the metal deposit and the mother plate on both sides of the plate. During the stripping stage, the cathode to be stripped is generally locked by the supporting bar in a similar vertical position as during the electrolytic stage. The stripping of the deposits is started from that edge of the mother plate which is close to and parallel to the supporting bar. When the stripping of the deposits will continue towards the cathode edge opposite and parallel to the supporting bar of the mother plate, the force caused by the stripping will all the time increase, and the effect of this force will be at the greatest in the outermost point of the deposit from the supporting bar of the mother plate. When this edge opposite to the supporting bar is protected by an edge strip, said bottom edge strip can be destroyed if the stripping is too strong, and the stripped deposit can even take away the bottom edge strip.

The object of the present invention is to obviate some of the drawbacks of the prior art and to produce an improved apparatus for preventing damages during the stripping stage of the mother plate in the edge strip installed on the edge opposite to the edge wherein the supporting bar of the mother plate is fixed. The essential features of the invention are listed in the enclosed claims.

SUMMARY OF THE INVENTION

According to the invention, in order to prevent damages during the stripping stage of the mother plate, in the edge strip installed on the edge opposite to the edge wherein the supporting bar of the mother plate is fixed, the mother plate is supported in a holder, so that in the holder there is at least one pressing member which will substantially tightly press the lower part of the deposit to be stripped against the mother plate. The press effect of the pressing member is thus unharmful for the edge strip installed on the edge opposite to the edge wherein the supporting bar of the mother plate is fixed. During the stripping stage the mother plate with deposits is in a vertical position, and therefore the edge opposite to the edge wherein the supporting bar of the mother plate is fixed, is the lower edge of the mother plate, and the edge strip on that edge is further called the bottom edge strip. In a similar manner, for instance the lower part of the deposit means the part of the deposit which is close to the edge opposite to the edge wherein the supporting bar of the mother plate is fixed.

When an object to be stripped, for instance a cathode from copper, zinc or nickel electrolytic refining, comes to the stripping stage, the cathode has been locked into the stripping device. At the same time the holder of the present invention is positioned so that the lower part of the cathode is pressed by at least one pressing member advantageously on both sides of the cathode. The pressing members are directed so that the contact between the pressing members and the cathode is created in the lower part of the deposit on the mother plate. The position for the contact between the pressing members and the cathode is arranged between 0.5 and 1.5 centimeters above the bottom edge strip.

Depending on the size of the mother plate, it can be advantageous to install in the holder of the present invention more than one pressing member on both sides of the mother plate. The pressing member can advantageously operate hydraulically, pneumatically as well as electrically depending for instance on the place where the holder is used. In one embodiment of the invention, the pressing members on the same side of the mother plate can be connected to each other by a connecting member. The pressing members on the same side of the mother plate can then advantageously be operated simultaneously. It is also advantageous that on both sides of the mother plate, there is provided the same amount of pressing members. Also the pressing members on both sides of the mother plate can advantageously be connected to each other, and they can then be operated substantially simultaneously. The pressing members are then inclinably installed to each other, so that the tilt angle is between 5 and 10 degrees when measured from the vertical position. The pressing effect on both sides of the mother plate is then substantially similar.

According to another embodiment of the invention, each pressing member is operated by a separate actuator of its own. The blank holder can also be operated so that the connecting members for the pressing members on both sides of the cathode can operate separately from each other. Also then the pressing member can advantageously operate hydraulically, pneumatically as well as electrically, depending for instance on the place where the holder of the invention is used.

When a cathode is stripped by using the pressing members in the holder of the invention, the cathode is first locked in the vertical stripping position and the pressing members in the holder are activated to press the lower parts of the deposits on both sides of the mother plate. The stripping of the deposits will start from the edge close to the supporting bar. When during the stripping the distance between the upper part of the deposit and the mother plate will increase, the deposit moves along the surface of the mother plate away from the bottom edge strip due to the pressing members in the holder. Because of this movement of the deposit, the contact between the deposit and the bottom edge strip becomes weaker. Thus, the pressing members in the holder of the invention also weaken the effect of the forces caused by the stripping towards the bottom edge strip.

BRIEF DESCRIPTION OF THE DRAWINGS

The invention is described in more detail with reference to the appended drawings, wherein.

DETAILED DESCRIPTION OF THE INVENTION

Figure 1:
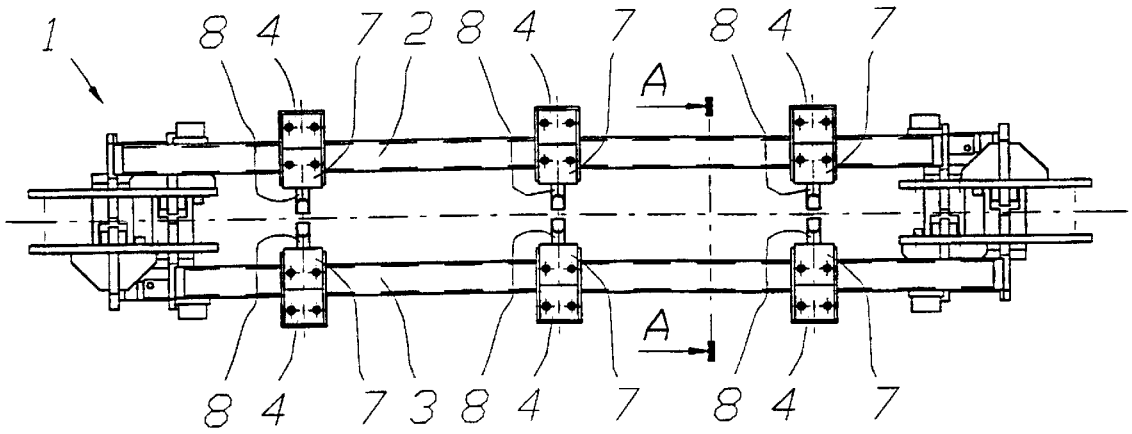
FIG. 1 is a top-view illustration of a preferred embodiment of the invention.
Figure 2:
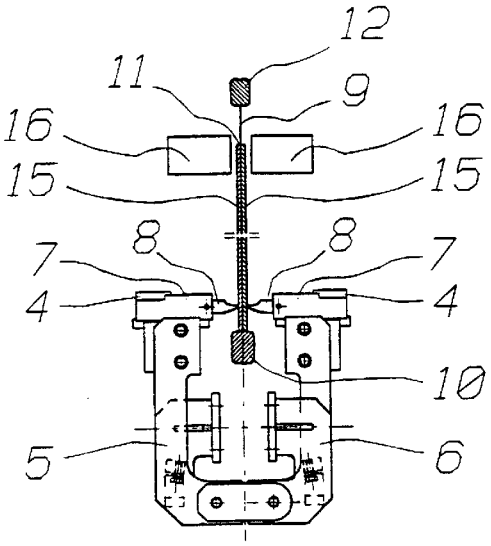
FIG. 2 is an A—A section view illustration of the embodiment in FIG. 1 when ready to operation.

In accordance with the FIGS. 1 and 2, the holder 1 of the invention is provided with pressing members 4 supported by members 2 and 3. The pressing member 4 has a frame 7 which is supported by one of the supporting members 2 and 3, and the pressing part 8 is fixed to the frame 7. The pressing members 4 are arranged so that each supporting member 2 and 3 includes the same amount of pressing members 4. The supporting members 2 and 3 are connected to each other by the connecting members 5 and 6. The connecting members 5 and 6 are at one end fastened with the supporting members 2 and 3 and at the other end connected inclinably to each other.

When starting the operation of the holder 1 of the invention, the connecting members 5 and 6 are tilted at an angle of about 8 degrees, counting from the vertical direction outwards from each other, so that there is a clear opening between the pressing parts 8 which are supported by the separate supporting members 2 and 3. The mother plate 9 with deposits 15 to be stripped comes to the stripping position in the stripping device 16, and the pressing parts 8 of the pressing members 4 are pressed against the deposits 15 on the point which is about 1 centimeter above the upper part of the bottom edge strip 10. The stripping of the deposits 15 on the mother plate 9 starts from the edge 11 close to the supporting bar 12 of the mother plate 9. During the stripping stage, the pressing parts 8 press the lower part of the deposit 15 against the mother plate 9. Because the distance between the deposit 15 and the mother plate 9 increases when the stripping goes forward to the lower part of the deposit 15, the lower part of the deposit 15 also tries to be released. Due to the pressing of the parts 8, the lower part of the deposit 15 moves up around the pressing parts 8, and simultaneously the contact between the bottom edge strip 10 and the deposit 15 becomes weaker and weaker, and finally in the end of the stripping the force effects against the bottom edge strip 10 caused by stripping cease to exist substantially in total. Thus the bottom edge strip 10 is workable for a new electrolytic refining stage.

Figure 3:
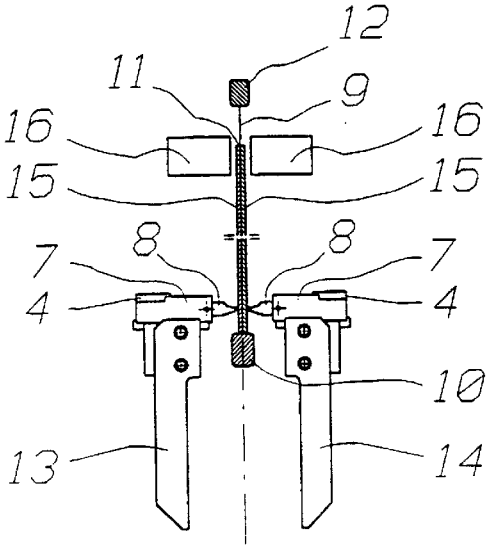
FIG. 3 is a side-view illustration of another preferred embodiment of the invention.

In FIG. 3, the pressing members 4 on the same side of the mother plate 9 are connected to each other by the connecting members 13 and 14 which are operated separately from each other. When the pressing members 4 are set in operation, the connecting members 13 and 14 are moved substantially in the horizontal direction towards the deposits 15 to be stripped, so that the press effect of the pressing members 4 is advantageous for preventing damages in the bottom edge strip 10.

What is claimed is:

1. Holder to be used during the stripping of a metal deposit produced on the surface of a mother plate in the electrolytic refining, which mother plate has a supporting bar (12) fixed in one edge of the plate for supporting the mother plate during the stripping (16), and an edge strip (10) at least on the edge opposite to wherein the supporting bar (12) is fixed, characterized in that the holder (1) has at least one pressing member (4) so that during the stripping (16) the metal deposit (15) is pressed by the pressing member (4) in order to make a contact between the deposit (15) and the pressing member (4) close to the edge strip (10) installed on the edge opposite to wherein the supporting bar (12) is fixed, in order to prevent damages in the edge strip (10).

2. Holder according to claim 1, characterized in that the holder (1) has at least one pressing member (4) for the deposits (15) on both sides of the mother plate (9).

3. Holder according to claim 2, characterized in that the holder (1) has on both sides of the mother plate (9) the same amount of the pressing members (4).

4. Holder according to claim 1, characterized in that the pressing members (4) in the holder (1) on the same side of the mother plate (9) have a common supporting member (2,3).

5. Holder according to claim 4, characterized in that the supporting members (2,3) are inclinably connected by the connecting members (5,6) to each other.

6. Holder according to claim 5, characterized in that the tilt angle for each supporting member (2,3) is between 5 and 10 degrees when measured from the vertical position.

7. Holder according to claim 4, characterized in that the supporting members (2,3) are operated separately.

8. Holder according to claim 1, characterized in that the contact between the pressing member (4) and the deposit (15) is placed between 0.5 and 1.5 centimeters above the edge strip (10) of the edge opposite to the edge wherein the supporting bar (12) of the mother plate (9) is fixed.

* * * * *